US007874262B2

(12) United States Patent
Bohnheio et al.

(10) Patent No.: US 7,874,262 B2
(45) Date of Patent: Jan. 25, 2011

(54) MASKING SYSTEM FOR THE MASKING OF A CRANK CHAMBER OF AN INTERNAL COMBUSTION ENGINE

(75) Inventors: Christian Bohnheio, Haegglingen (CH); Gerard Barbezat, Winterthur (CH)

(73) Assignee: Sulzer Metco AG, Wohlen (CH)

( * ) Notice: Subject to any disclaimer, the term of this patent is extended or adjusted under 35 U.S.C. 154(b) by 838 days.

(21) Appl. No.: 11/827,775

(22) Filed: Jul. 13, 2007

(65) Prior Publication Data

US 2008/0017159 A1 Jan. 24, 2008

(30) Foreign Application Priority Data

Jul. 24, 2006 (EP) ..... 06117756
May 4, 2007 (EP) ..... 07405133

(51) Int. Cl.
*B05C 11/11* (2006.01)

(52) U.S. Cl. ..... 118/504

(58) Field of Classification Search ..... 427/448, 427/236, 239, 510; 118/504
See application file for complete search history.

(56) References Cited

U.S. PATENT DOCUMENTS 5,573,814 A 11/1996 Donovan
6,395,090 B1 * 5/2002 Shepley et al. ..... 118/504
2002/0078887 A1 * 6/2002 Shepley et al. ..... 118/504
2002/0172769 A1 * 11/2002 Herber et al. ..... 427/271
2003/0154919 A1 8/2003 Rice et al.

FOREIGN PATENT DOCUMENTS

EP 1 077 090 A2 2/2001
EP 1 136 583 A1 9/2001
EP 1 350 862 A1 10/2003
JP 06065711 A 3/1994

* cited by examiner

*Primary Examiner*—M. McMahon
(74) *Attorney, Agent, or Firm*—Townsend and Townsend and Crew, LLP

(57) ABSTRACT

The invention relates to a masking system (1) for the masking of a crank chamber (2) of an internal combustion engine (3) during a surface treatment of a cylinder running surface (4, 41, 42) of a cylinder bore (5, 51, 52) of a cylinder (6, 61, 62) of the internal combustion engine (3). The masking system (1) includes a hollow masking body (7) with a connector segment (71) for the connection of the hollow masking body (7) to the cylinder bore (5, 51, 52) as well as a screen segment (72). In accordance with the invention, the hollow masking body (7) is configured such that the connector segment (71) of the hollow masking body (7) can be positioned on the cylinder bore (51) of the first cylinder (6, 61) at the crank chamber side during the surface treatment of a first cylinder (6, 61) of the internal combustion engine (3). The invention further relates to the use of a masking system (1) in accordance with the invention.

20 Claims, 3 Drawing Sheets

MASKING SYSTEM FOR THE MASKING OF A CRANK CHAMBER OF AN INTERNAL COMBUSTION ENGINE

CROSS-REFERENCES TO RELATED APPLICATIONS

This application claims the priority of European patent application No. 06117756.4, filed Jul. 24, 2006, and European patent application No. 07405133.5, filed May 4, 2007, the disclosures of both of which are incorporated herein by reference.

BACKGROUND OF THE INVENTION

The invention relates to a masking system for the masking of a crank chamber of an internal combustion machine during a surface treatment of a cylinder running surface as well as to the use of a masking system in accordance with the present invention.

The thermal coating of cylinder running surfaces of internal combustion engines by different thermal spray processes is state of the art today and is in particular widely used on engines for motor vehicles of all types, but not just here. Usually, the corresponding cylinder running surfaces are activated before the thermal coating by different processes, e.g. by corundum blasting, hard cast blasting, high-pressure water blasting, various laser processes or other activation processes known per se. Substrates of light metal alloys on an Al or Mg base are most frequently pre-treated and subsequently coated.

A widely used type of engine is an engine in a V design, that is, an engine which has two cylinder rows running parallel to one another, with the two longitudinal axes of two adjacent cylinder liners which each belong to one of the two cylinder rows being inclined by a specific angle with respect to one another, whereby the characteristic V shape of the engine block of an engine in V design arises.

In such V engines, the risk exists on thermal coating that, during a surface treatment of the cylinder running surfaces, e.g. on the activation, cleaning or another pre-treatment of the cylinder running surfaces, surfaces of the crank chamber of the engine block or cylinder running surfaces of adjacent cylinder bores can also be affected in an uncontrolled manner. Corresponding problems also occur above all on the thermal coating of the cylinder wall of a cylinder of the internal combustion engine. On the coating of a cylinder running surface of a cylinder bore of a first cylinder row, vapors, e.g. metal vapors of the coating material, which can never be completely avoided in thermal coating, can namely be deposited on the cylinder wall of an adjacent cylinder.

Due to the deposition of the metal vapors at the relatively cold walls on the cylinder wall of the cylinder, e.g. of the second cylinder row, this cylinder wall in the second cylinder row is contaminated by the metal vapors, which inter alia has a negative effect on the adhesion of a coating likewise still to be applied to this cylinder later. In addition, a contamination by unmelted particles and by overspray is to be feared and also the inner surfaces of the crankcase can be contaminated in a disadvantageous manner or also be affected.

A further problem is the heating of the engine block by the thermal coating process. Since the difference in the thermal coefficient of expansion between the thermal spray coating and the substrate can be relatively high, a temperature of the substrate of more than 120° C., with this substantially having to be understood as a type of mean temperature of the engine block, has a negative effect on the internal stress level of the layers, and above 150° C. there is even the risk that the component made from a light metal alloy, that is, the engine block, suffers deformation of the material and thus becomes unusable.

This problem becomes particularly clear when one looks at the thermal coefficients of expansion of typical materials used: typical coefficients of expansion of thermal spray coatings from alloys on an iron base lie e.g. at approx. $11\times10^{-6}$/° C., whereas typical thermal coefficients of expansion of substrates on an aluminum base can lie at approx. $23\times10^{-6}$/° C. and for substrates on a magnesium base typically at $27\times10^{-6}$/° C. This means that typical thermal coefficients of expansion of the substrates, that is, of the material from which the engine blocks are made, are of an order of magnitude of more than twice as large as the thermal coefficients of expansion of the thermal spray coatings sprayed on.

Various apparatuses are known in the prior art which in particular attempt to solve the problem of the contamination of cylinder running surfaces with the previously mentioned metal vapors.

Apparatuses are thus known in which cylinder bores which are not coated are sealed with a type of inflatable balloon, which can, however, lead to heat accumulation and aggravate the above-mentioned problems with the thermal coefficients of expansion even more. Other systems are in use in which covers are introduced through the crankshaft housing for the protection of the cylinder bores which are not to be coated. The thermal problems are also ultimately not completely solved here and, which is at least just as important, the use of all known systems can only be automated with great difficulty, if at all, in particular in the case of engines in the V design, so that the coating process ultimately becomes very expensive because a lot of manual work is required in the coating of a large number of engine blocks.

SUMMARY OF THE INVENTION

It is therefore an object of the present invention to provide an apparatus with which the problems known from the prior art, in particular the thermal problems and the problems with the contamination by metal vapors in the thermal coating of cylinder bores, are avoided, with a high degree of automation simultaneously being achievable in a simple and cost-effective manner.

The invention thus relates to a masking system for the masking of a crank chamber of an internal combustion engine during a surface treatment of a cylinder running surface of a cylinder bore of a cylinder of the internal combustion engine. The masking system includes a hollow masking body with a connector segment for the connection of the hollow masking body to the cylinder bore as well as a screen segment. In accordance with the invention, the hollow masking body is configured such that the connector segment of the hollow masking body can be positioned on the cylinder bore of the first cylinder at the crank chamber side during the surface treatment of a first cylinder of the internal combustion engine.

In the coating of cylinder crankcases in a V design, preferably one cylinder row in each case is coated by means of a rotating thermal spray device, for example by means of a rotating plasma burner. The cylinders which are not to be coated are protected by a masking system in accordance with the invention such that e.g. a plasma jet of a rotating plasma injection apparatus which is guided through a cylinder bore in an axial direction during coating, with a lower reverse point being able to lie in the region of the masking body, does not reach the cylinder walls of the cylinder row not to be coated. That is, the feared "overspraying" does not occur, that is, the contamination of a cylinder wall not to be coated by overspraying from a cylinder bore which is currently being coated. It is thereby prevented that layer peelings occur such as are known from the prior art, which occurs when a cylinder wall previously contaminated with metal vapors is coated later.

It is important for the invention that the masking body is a hollow masking body, on the one hand, through which cooling and flushing fluids can thus flow during a surface treatment, such as on the activation of the cylinder running surfaces by a jet process or on the thermal coating of the cylinder running surfaces and through which, on the other hand, the treatment apparatus, that is, for example, a water jet apparatus or a rotating plasma burner, can also be guided.

Heat arising by the fluid in thermal coating, for example, can thereby be reliably dissipated and, on the other hand, it can also be prevented by the fluid, which can, for example, be air, a chemically active gas such as oxygen and/or an inert gas such as nitrogen and/or a noble gas and/or another fluid, so that metal vapors or blasting particles which are used on the activation of the cylinder running surfaces or other damaging contaminants are reliably disposed of through the crank chamber without e.g. inner surfaces of the crankcase or cylinder running surfaces being negatively influenced or contaminated.

In addition, in certain cases, the chemical composition of the coating to be sprayed can also be influenced by the composition of the fluid used, for example by the amount of oxygen or other chemical elements it contains.

Furthermore, the hollow masking body of the present invention is configured such that its connector segment can be positioned at the cylinder bore of a first cylinder at the crank chamber side to be treated in the operating state. This means that, in accordance with the invention, the hollow masking body is not positioned in the interior of the cylinder bore, but at the crank chamber side in front of the cylinder bore, with at most a small marginal region or ring region, as will be explained further below, being able to be covered at the crank chamber side by a masking body over a narrow ring-shaped region of a width of e.g. 1 mm since no coating is desired for technical reasons in this region. It is understood that the narrow, covered ring region can also be narrower or wider than 1 mm.

The screen segment which extends away from the cylinder bore into the crank chamber ensures that the damaging particles already mentioned several times above, such as metal dust from thermal spraying or blasting particles from the activation of the cylinder running surfaces, are reliably guided out of the crankcase without cylinder running surfaces of adjacent cylinders or inner surfaces of the crankcase being negatively influenced, because they can practically no longer reach the aforesaid surfaces on the use of the masking system in accordance with the invention.

It is thus a decisive difference of the masking system in accordance with the invention with respect to the known masking systems that the masking body of the masking system in accordance with the invention is positioned in front of the cylinder bore at the crank chamber side to be treated and thereby e.g. protects the adjacent cylinders from damaging influences, whereas the known systems are each provided at or in the cylinder bores not to be treated.

The solutions known from the prior art therefore additionally have the disadvantage, in addition to the disadvantages already discussed in detail above, that generally every surface not to be treated must be protected. That is, e.g. every single cylinder bore or cylinder running surface which should not be treated, that is, e.g. which should currently not be thermally coated, must be protected by its own masking, whereas, when a hollow masking body in accordance with the invention is used, only the cylinder currently to be worked, e.g. to be coated, has to be masked. Other surfaces such as the inner surface of the crank chamber can frequently moreover not be screened at all with systems known from the prior art. The known masking systems are thus a lot more complex per se in an apparatus aspect, are more expensive to purchase and are more complicated in use, which in particular frequently makes an automated handling in mass production very difficult or even impossible.

A maximum outer diameter of the hollow masking body is preferred in this connection which is somewhat smaller than the diameter of the cylinder of the cylinder running surface to be treated. The diameter of a hollow masking body in accordance with the invention is thus e.g. approx. 1 mm smaller than the diameter of the still uncoated cylinder bore. It is thereby possible to introduce the masking body in accordance with the invention through the cylinder bore from above, that is, through the opening of the cylinder bore remote from the crank chamber, and to position it in front of the opening of the cylinder bore at the crank chamber side facing the crank chamber.

An automation of the positioning of the masking system is thereby made much simpler because the awkward introduction of the masking body through the geometrically complex crankshaft housing is omitted. It is actually the case in a number of circumstances that a masking body cannot be guided through the crankshaft housing at all to the cylinders to be coated due to geometrical hindrances and due to tight space conditions, above all with smaller engine types. The masking system in accordance with the invention above all proves superior here.

Since, as mentioned above, the diameter of the masking body is selected to be suitably smaller than the diameter of the cylinder bore to be coated, the masking body can also be removed comfortably again through the coated cylinder bore after the coating of the cylinder running surface of the cylinder. If, as in the above example, the diameter of the masking system is approx. 1 mm smaller than the diameter of the uncoated cylinder bore, the masking body can also be comfortably removed again through the coated cylinder after the coating with a typical coating thickness of the cylinder running surface of e.g. 250 μm.

It is understood that, depending on application, the difference in the diameter between the cylinder bore and the masking body can also be larger or smaller than 1 mm and that the masking system in accordance with the invention can also be used successfully when the coating to be applied has a larger or smaller thickness than 250 μm.

In a preferred embodiment, the hollow masking body is configured at least sectionally, specifically completely, as a hollow cylinder with a varying or constant inner diameter.

In this connection, the hollow masking body can include a fastening segment which is provided between the connector segment and the screen segment in an embodiment particularly important for practice, with the fastening segment extending in a funnel shape, in particular tapering in a funnel shape from the connector segment to the screen segment. It is thereby achieved, on the one hand, that the cooling and flushing fluid to be drained off as well as particles or coating dust to be led away can be guided out of the crankcase in a well-defined direction and in a more or less compact jet. On the other hand, such an embodiment can above all be used particularly advantageously in a narrow crankcase because it takes up less space than a masking body with a fastening element not tapering accordingly.

It is understood that the fastening element can also be shaped differently for particular applications; that is, it can, e.g., extend from the connector segment to the screen segment in an expanding funnel-like manner, can have a constant diameter or can be suitably shaped in a different manner.

It is moreover clear that the fastening segment and the screen segment can also have a tapering shape, an expanding shape, a shape with a constant diameter or any other suitable shape.

As already described in detail above, the hollow masking body of the present invention is configured such that its connector segment can be positioned at the cylinder bore of a first cylinder at the crank chamber side to be treated in the operating state. That is, in accordance with the invention, the hollow masking body is not positioned in the interior of the cylinder bore, but in front of the cylinder bore at the crank chamber side. In this connection, a small marginal region or ring region of the masking body can extend into the cylinder bore at the crank chamber side so that a narrow ring region of the cylinder running surfaces is covered by the masking body in a width of e.g. 1 mm-5 mm since no coating is desired in this region for technical reasons.

I.e., after the coating of a specific cylinder running surface, the previously described narrow region remains uncoated on the cylinder running surface on the side of the crank chamber.

However, as likewise already explained, in particular for reasons of adhesion of the thermal spray layer on the cylinder running surface, the cylinder running surface should be activated before the application of the thermal spray layer, e.g. by means of one of the methods initially mentioned. In this connection, the narrow region which should not be coated should advantageously likewise also be activated since this increases the stability and adhesion of the thermal spray layer at the crank chamber side in the marginal region and e.g. prevents an eruption of the layer in the marginal region.

A first masking body would therefore have to be used before the activation process whose connector segment has a width which permits the cylinder surface also to be activated in the already mentioned narrow region at the crank chamber side. Since this region should, however, not be coated in the subsequent coating process, the first masking body used in the activation would have to be removed prior to the coating and be replaced by a second masking body which has a somewhat wider connector segment than the first masking body so that the narrow region of the cylinder bore at the crank chamber side is not also coated due to the second masking body.

It is obvious that this is a procedure which is undesirably complicated and costly.

In a special embodiment, a masking body in accordance with the invention therefore includes a cover ring which is releasably connected to the connector segment and which is not connected to the connector segment during the activation process so that the narrow region at the crank chamber side is not covered during the activation of the cylinder running surface and the narrow region of the cylinder running surface on the crank shaft side is likewise activated.

At the end of the activation process, it is then only necessary for the cover ring to be introduced through the corresponding cylinder bore and to be connected to the connector segment, e.g. in a suitable groove in the connector segment, so that the narrow region of the cylinder running surface at the crank chamber side is not coated in the subsequent coating process. In this connection, the connection between the cover ring and the connector segment can e.g. also take place magnetically if, for example, the cover ring and the connector element are made of a magnetic material, or can take place via an adhesive bond or by any other type of connection known per se to the skilled person.

Furthermore, a connection element, for example in the form of a holder which is releasably connectable to the masking body and/or to the crankcase, can be provided for the fixing of the masking body.

The masking body can be connected to the connection element mechanically, e.g. by means of screws or bolts, in particular also pneumatically or hydraulically and/or magnetically and/or by means of an adhesive bond. The different possibilities of the releasable connection of two mechanical components are known per se to the skilled person and do not need to be discussed further in any detail.

The same applies to the connection of the connection element and the crankcase. The connection element can be connected to the crankcase mechanically, in particular pneumatically or hydraulically and/or magnetically and/or by means of an adhesive bond, or by means of any other suitable connection means.

In another embodiment, the connection element can in particular also be omitted and the hollow masking body can also be connected directly to the crankcase mechanically, in particular pneumatically or hydraulically and/or magnetically and/or by means of an adhesive bond, or by means of any other suitable connection means.

A circumferential groove can in particular be provided at the crank chamber side at the lower end of the cylinder bore in the cylinder running surface, the groove being provided anyway for technical reasons or being introduced separately for the fixing of a masking body in accordance with the invention so that the masking body can be fixed quickly and reliably in a simple manner, above all also automatically, e.g. by means of a robot system, to the cylinder bore in the circumferential groove, for example, by means of a clamping ring, e.g. a circlip, which is suitably provided at the masking body, and can be removed again automatically just as simply after the working.

Instead of the clamping ring, a hydraulically or pneumatically operable circumferential ring element can also be provided at the masking body and expands e.g. under the action of pressure into the circumferential groove in the cylinder running surface and thus fixes the masking body to the cylinder bore.

The hollow masking body and/or the connection element can be manufactured, for example, from metal or a metal alloy, in particular from aluminum or an aluminum alloy and/or from a magnetic steel and/or from a plastic, in particular from a plastic injection molding, specifically from a plastic injection molding including magnetic elements and/or from a composite material, in particular from a composite material including magnetic elements. Above all, injection molded parts present themselves for industrial mass production since they can be manufactured simply in large volumes, very cost effectively and in practically any desired shape and geometry.

In practice, the masking system in accordance with the invention can include at least two hollow masking bodies so that at least two cylinders, preferably two adjacent cylinders, can be masked simultaneously and/or the masking system can include a presettable number of hollow masking bodies so that specifically a complete cylinder row of an internal combustion engine in a V design, in particular two oppositely disposed complete cylinder rows of an internal combustion engine in a V design, can be masked simultaneously. The change between the processing of two different cylinder bores in automated operation can thereby take place a lot faster.

It is understood in this connection that, in a masking system in accordance with the invention, a masking body can also advantageously be combined with other protective devices, such as with a masking element, in specific cases.

For instance, a masking element can additionally be provided for the masking of a second cylinder bore during the thermal coating process and/or during another treatment process, such as on the activation of the cylinder running surface, the masking element being able to be positioned in the cylinder bore of the second cylinder during the treatment of the surface, that is, for example, during the thermal coating process of the first cylinder for the covering of the cylinder running surface of the second cylinder. The masking element is advantageously configured such that a flow gap of a presettable width can be set for the generation of a flow of a fluid between the masking element and the cylinder running surface of the second cylinder.

It is important in this connection that the masking system in accordance with the invention additionally includes a masking element which, on the one hand, substantially completely covers a cylinder wall of a cylinder bore not to be coated during the coating of another cylinder wall and thus protects it from the direct application of metal vapors which originate from the coating jet and with which the other cylinder is coated. That is, it prevents the cylinder wall not to be coated from being indirectly or directly exposed to the coating jet. This is admittedly already ensured in many cases relevant to practice by the masking body alone. In very specific cases in which, for example, extremely high demands are made on the protection of the cylinder bores currently not to be coated or in which particularly high protective measures against thermal strains on these cylinder bores not to be coated are required, the additional use of a masking element may be necessary.

In this connection, the masking element is configured such that a flow gap remains free between the masking element and the cylinder wall currently not to be coated so that an air flow can be generated therein which, on the one hand, effects a cooling of the engine block in the covered cylinder bore and, on the other hand, prevents metal dust which is distributed in the interior of the engine block, even though only in a low concentration on the use of the masking body, from being deposited on the cylinder wall currently not to be coated.

If a specific embodiment of the invention is considered, a closed tube with a controlled flow gap between the tube and the cylinder running surface is thus e.g. introduced on an oppositely disposed cylinder during the coating. A flow of air or of other fluids is achieved by corresponding openings and an appropriate suction, the flow cooling the cylinder running surface and simultaneously preventing the deposition of metal vapors on this cylinder running surface since the flows or turbulences of the metal vapors can be effectively repressed.

For example, in the coating of cylinder crankcases in a V design, a respective cylinder row is preferably coated. The cylinder row disposed opposite it can be protected by a masking element such that e.g. a plasma jet of a rotating plasma spray device, which is guided through the cylinder bore in an axial direction, does not reach the cylinder walls of the cylinder row not to be coated.

In addition, as already mentioned, a heating of the cylinder block by the heat transfer of melted powder to the substrate, which necessarily takes place during the coating process, is reduced even further. An overheating is in particular to be avoided at all costs with thin-walled components because this can result in overheating of the cylinder block, which can likewise have the consequence of damaging layer peeling. These damaging effects are also avoided by the use of this embodiment of a masking system in accordance with the invention because the masking system of the present invention ensures a careful temperature management during the coating process due to the regulation of the fluid through the flow gap.

In a special embodiment, the masking element is a hollow masking element or a solid masking element, preferably a hollow masking cylinder or a solid masking cylinder.

The masking element is preferably configured so that the flow gap has a width of 0.1 mm to 10 mm, preferably a width between 0.2 mm and 5 mm, specifically a width between 0.4 mm and 3 mm. It is thereby simultaneously ensured that the flow gap is narrow enough so that a direct contamination of the cylinder wall of the cylinder protected by the masking element can be prevented and simultaneously a sufficiently strong flow can be maintained in the flow gap so that a sufficient cooling can be achieved.

In a specific embodiment, a masking system in accordance with the invention includes at least two masking elements so that at least two cylinders, preferably two adjacent cylinders, can be masked simultaneously, with the masking system including a presettable number of masking elements in an embodiment of particular importance for practice and being configured such that a complete cylinder row of an internal combustion engine in a V design can be masked simultaneously.

The masking element preferably includes a masking cover and the masking cover in particular includes a passage in communication with the flow gap, in particular an outlet passage and/or an inlet passage for the conveying of the fluid. The passage can have openings of which one or more can be provided in the masking cover via which the fluid, e.g. air or another gas, can be sucked out by a suction device which can be provided on the crankcase so that the flow in the flow gap between the masking body and the cylinder wall can thereby be established.

It is understood that in another embodiment air or another gas can also be introduced into the flow gap at a presettable pressure via the openings, of which a plurality can be provided, for example, in the mask cover and can be arranged e.g. circularly in proximity to a margin of the masking cover, or can be sucked out via the openings, with the flow direction of the fluid being directed either into the crankcase or out of it depending on whether the fluid is blown into the openings or sucked out of them under pressure. The person skilled in the art understands that the shape of the openings can differ in dependence on the demand; e.g. circular openings, slit-shaped openings or openings of another suitable shape can be provided.

As mentioned, the masking system can include a suction means so that the flow of the fluid can be sucked out through the crank chamber through the hollow masking body and/or through the hollow masking element and/or through the flow gap.

Alternatively or additionally, a feed means can also be provided for the feeding of the fluid into the hollow masking body and/or into the masking element and/or into the flow gap so that the flow of the fluid through the hollow masking body and/or through the masking element and/or through the flow gap can be generated under a presettable infeed pressure.

In particular a gas or a gas mixture, specifically air and/or nitrogen and/or a noble gas, in particular argon and/or helium, are particularly well-suited for the generation of the flow in the flow gap and/or in the masking body.

A flow speed of the fluid in the flow gap is preferably larger than 1 m/s, in particular larger than 10 m/s, and specifically lies between 1 m/s and 150 m/s, preferably between 10 m/s and 80 m/s. A sufficient cooling of the engine block is thereby achieved, on the one hand, and a sufficiently strong current is generated in the flow gap, on the other hand, so that no metal vapor can be deposited on a cylinder running surface which is not to be coated and which is protected by a masking system in accordance with the invention.

A manipulator, in particular a program controlled robot system, can in particular be provided for the positioning of the masking body to advantageously automate the coating process of cylinder running surfaces of engine blocks for industrial mass production so that the masking body and/or the masking element can be positioned automatically in accordance with a presettable program routine scheme in and/or at the cylinder bore and/or a supply unit for the provision of the fluid is provided which can preferably be controlled and/or regulated in a program controlled manner.

The supply unit for the provision of the fluid can advantageously be controlled and/or regulated in a program controlled manner such that e.g. the flow rate and/or the pressure and/or the flow speed of the fluid flow in the flow gap and/or in the masking body can be controlled and/or regulated and can e.g. be controlled and/or regulated in dependence on the time, on the type of the engine block to be coated or in dependence on specific coating parameters such as temperature, type of coating apparatus used, type of coating material, type of coating process, etc.

The invention further relates to the use of a masking system in accordance with the invention, with the thermal coating process including a plasma spray process, in particular using a rotating plasma spray device, preferably a plasma APS process, a flame spraying process, in particular a high speed flame spraying process, and/or another thermal spray process such as an arc wire spray process.

In this connection, a masking system in accordance with the invention is in particular used as protection from contamination of a cylinder bore and/or for cooling during the thermal coating process.

The invention will be explained in more detail in the following with reference to the drawing.

DESCRIPTION OF THE PREFERRED EMBODIMENTS

Figure 1:
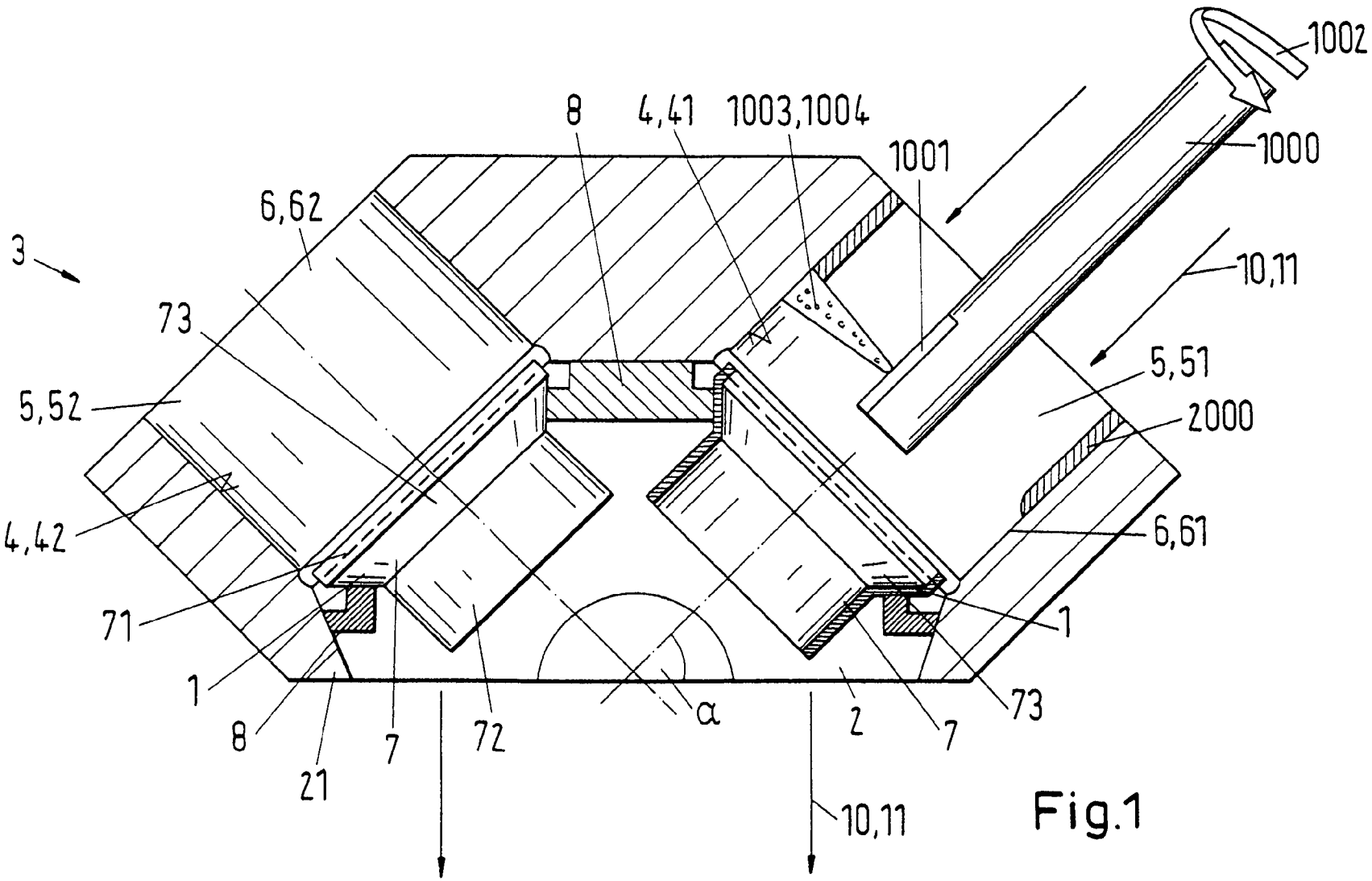
FIG. 1 is a section through a cylinder block of an engine in a V design with a masking system in accordance with the invention.
Figure 3:
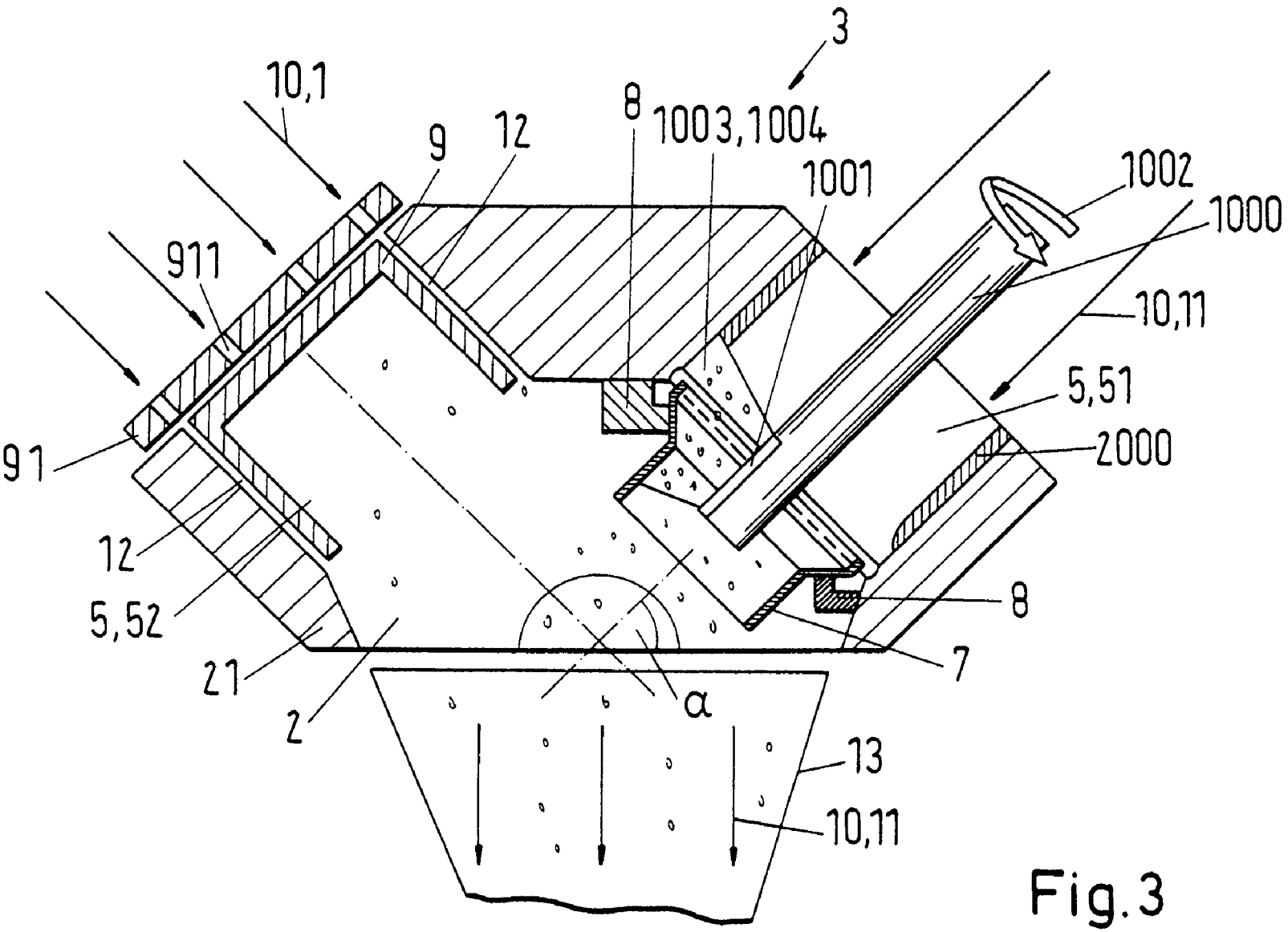
FIG. 3 shows a masking system with a masking element and a suction device.

FIG. 1 and FIG. 3 show, in an illustration in section, two simple embodiment variants of a masking system in accordance with the invention during the coating of a cylinder bore of an engine in a V design at which the function of a masking system in accordance with the invention is schematically explained which is designated in total in the following by the reference numeral 1.

In this connection, the masking system of FIG. 3 additionally includes a masking element 9 for the protection and for the better cooling of a cylinder running surface 4, 42 not to be coated.

In FIG. 1 and FIG. 3, a section through an engine block of an engine in the V design is shown whose two cylinder rows are arranged parallel to one another at an angle of inclination $\alpha$ in a known manner.

A first cylinder 6, 61, the right-hand cylinder in accordance with the representation, is just being coated using a rotating plasma spray gun 1000 known per se. The plasma spray gun 1000 rotates around a longitudinal axis, as indicated by the arrow 1002, during the coating process in the cylinder 6, 61 and is guided during the coating process under rotation in the axial direction through the cylinder bore 5, 51. At a lower end of the plasma spray gun 1000, a plasma jet 1003 with coating material 1004 exits a spray opening 1001 and the cylinder running surface 4, 41 of the cylinder 6, 61 is coated with the coating material 1004.

In the example of FIG. 1, only just the upper half of the cylinder is provided with a thermal coating 2000. The plasma spray gun is still so far away from its lower reverse point that the plasma jet 1003 impacts the cylinder running surface 4, 41 in its full width.

In the example of FIG. 3, the plasma spray gun 1000 is already in the proximity of its lower reverse point. That is, the plasma jet 1003 with coating material 1004 is not only incident on the cylinder running surface 4, 41 of the cylinder 6, 61 to be coated, but also already reaches a little into the crankcase of the V engine 3. Without the masking body 7 in accordance with the invention, the other cylinder running surfaces 4, 42 not to be coated as well as the inner surfaces of the crank chamber 2 would be contaminated by particles 1004 from the coating jet 1003 and would moreover be heated excessively by the plasma jet 1003.

The masking body 7, including the connector segment 71, the screen segment 72 and the fastening segment 73, is connected in FIG. 1 and FIG. 3 by means of a plurality of connection elements 8 to the crankcase 21 by screw connections not shown in any more detail.

Since the engine 3 of FIG. 3 is a highly sensitive high performance engine 3, a masking element 9 is additionally provided here in the cylinder bore 5, 52 of the second cylinder 6, 62 above all for the achieving of a better cooling and is configured in the present example of FIG. 3 as a hollow cylinder 9 and additionally includes a masking cover 91. The masking cover 91, which forms a cover on the second cylinder 6, 62 or on the marking element 9, includes a passage 911 with openings which is connected to the flow gap 12 configured between the masking cylinder 9 and the cylinder running surface 4, 42 which, in the example of FIG. 3, is made as an inlet passage 911 for the conveying of fluid 11 into the flow gap 12.

In this connection, the flow 10 of the fluid 11 in the flow gap 12 is generated by a suction means 13 which is shown only schematically in FIG. 3 and which generates a presettable underpressure in the crankcase in a manner known per se to the skilled person so that e.g. air 11 is sucked in through the openings of the passages 911 in the masking cover 91 which then flows through the flow gap 12 connected to the openings of the passages 911 so that the cylinder 6, 62 and thus also the complete engine block of the internal combustion engine 3 is additionally cooled and, on the other hand, a deposition of metal vapors on the cylinder running surface 4, 42 of the second cylinder 6, 62 can be prevented in an even more ideal manner.

Figure 2:
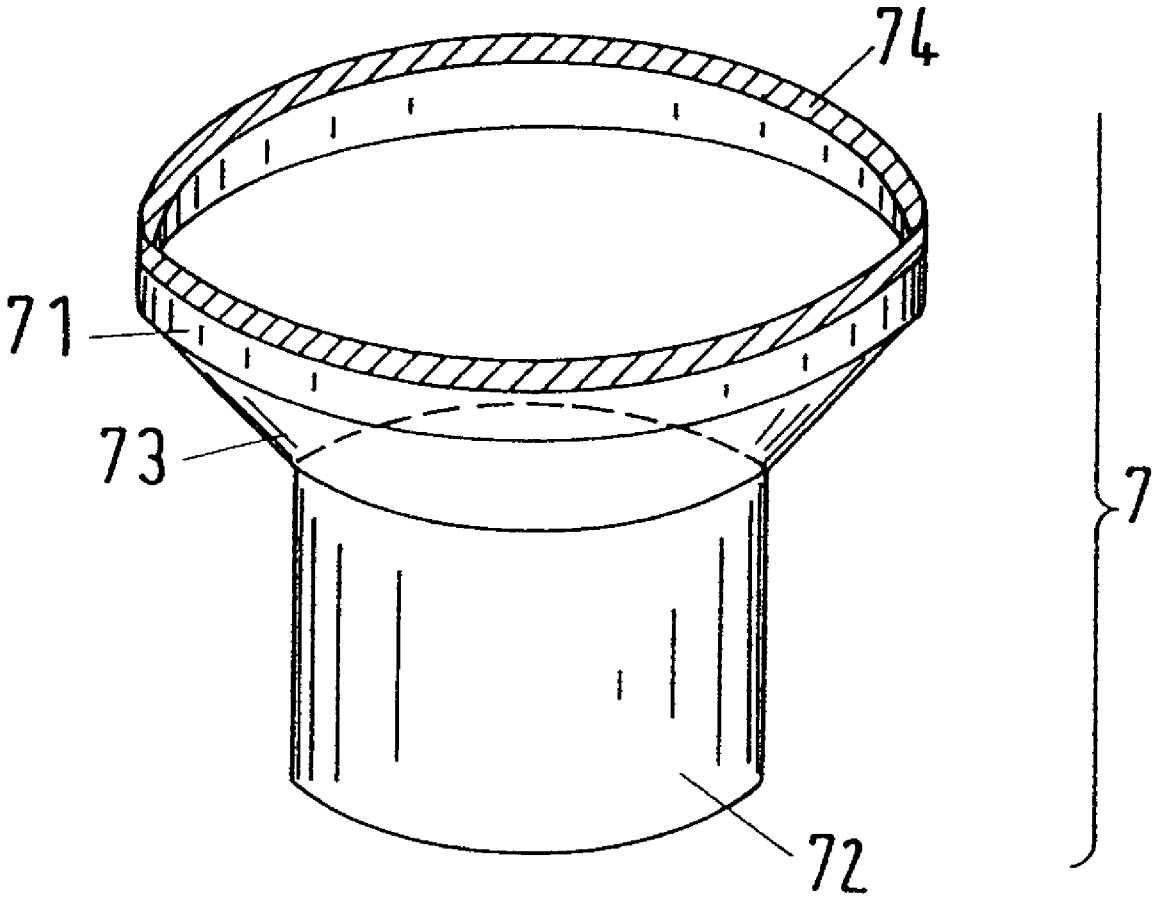
FIG. 2 shows a masking body in detail.

In FIG. 2, a masking body 7 in accordance with the invention is shown in detail again for illustration.

The hollow masking body 7 includes a connector segment 71 for connection of the hollow body 7 to the cylinder bore 5, 51, 52 as well as a screen segment 72. Additionally, a fastening element 73 is provided between the connector segment 71 and the screen segment 72 and tapers in funnel shape from the connector segment 71 to the screen segment 72. Since the diameter of the fastening element 73 reduces in the direction towards the screen segment 72, the screen segment 72 can have a smaller diameter than the connector segment 71, whereby the coating particles to be led away can be led out of the crank chamber 2 in a more directed manner and, at the same time, the tight space conditions in the crank chamber 2 can be taken into account better, which is often even more important.

The specific embodiment of FIG. 2 has a cover ring 74 which is releasably connected to the connector segment 71 so that, as described above, the whole masking body 7 does not have to be replaced between an activation treatment of the cylinder running surface 4, 41 and a subsequent coating process.

It is understood that the invention is not restricted to the described embodiments and in particular all suitable combinations of the embodiments shown are also covered by the invention.

The invention claimed is:

1. A masking system for the masking of a crank chamber of an internal combustion engine during a surface treatment of a cylinder running surface of a cylinder bore of a first cylinder of the internal combustion engine, including a hollow masking body with a connector segment for the connection of the hollow masking body to the cylinder bore as well as with a screen segment, the hollow masking body is being configured such that the connector segment of the hollow masking body can be positioned at the cylinder bore of the first cylinder at the crank chamber side during the surface treatment of the first cylinder of the internal combustion engine, and a masking element for masking a second cylinder bore during the thermal coating process, the masking element being able to be positioned in the cylinder bore of the second cylinder during the thermal coating process of the first cylinder for the covering of the cylinder running surface of the second cylinder, the masking element being configured such that a flow gap of presettable width can be set for the generation of a flow of a fluid between the masking element and the cylinder running surface of the second cylinder.

2. A masking system in accordance with claim 1, wherein the hollow masking body is a hollow cylinder.

3. A masking system in accordance with claim 1, wherein the hollow masking body includes a fastening element.

4. A masking system in accordance with claim 3, wherein the fastening segment is provided between the connector segment and the screen segment.

5. A masking system in accordance with claim 4, wherein the fastening segment extends in the manner of a tapering funnel, from the connector segment to the screen segment.

6. A masking system in accordance with claim 5, wherein the connector segment includes a releasably connected cover ring.

7. A masking system in accordance with claim 1, wherein a connection element is provided for the fixing of the masking body to a crankcase of the crank chamber.

8. A masking system in accordance with claim 1, wherein the masking body is connected to the connection element at least one of pneumatically, hydraulically, magnetically, or by means of an adhesive bond.

9. A masking system in accordance with claim 1, wherein the connection element is connected to the crankcase at least one of pneumatically, hydraulically, magnetically, or by means of an adhesive bond.

10. A masking system in accordance with claim 1, wherein the hollow masking body is connected directly to the crankcase at least one of pneumatically, hydraulically, magnetically, or by means of an adhesive bond.

11. A masking system in accordance with claim 1, wherein the hollow masking body and/or the connection element is manufactured from at least one of aluminum or an aluminum alloy, magnetic steel, a plastic injection molding including magnetic elements, or a composite material including magnetic elements.

12. A masking system in accordance with claim 1, wherein the masking system includes a presettable number of hollow masking bodies so that a complete cylinder row of an internal combustion engine having two oppositely disposed complete cylinder rows of an internal combustion engine in a V design can be masked simultaneously.

13. A masking system in accordance with claim 1, wherein the masking element is a hollow masking cylinder or a solid masking cylinder.

14. A masking system in accordance with claim 1, wherein the masking element includes a masking cover and the masking cover in particular includes a passage connected to a flow gap.

15. A masking system in accordance with claim 14, wherein a suction means is provided such that a flow of the fluid can be sucked out through at least one of the crank chamber through the hollow masking body, through the hollow masking element, or through the flow gap.

16. A masking system in accordance with claim 1, wherein a feed means is provided for at least one of feeding of fluid into the hollow masking body, into the masking element, or into the flow gap so that the flow of the fluid through the at least one of the hollow masking body, through the masking element, or through the flow gap can be generated under a presettable infeed pressure.

17. A masking system in accordance with claim 1, wherein a manipulator is provided such that at least one of the masking body or the masking element can be positioned automatically in accordance with a presettable program starting scheme in at least one of in or at the cylinder bore or wherein a supply unit is provided for the provision of the fluid which can be controlled and/or regulated in a program controlled manner.

18. Use of a masking system in accordance with claim 1, wherein the thermal coating process includes at least one of a plasma spray process, a plasma APS process, a flame spraying process, a high speed flame spraying process, or an arc wire spray process.

19. A masking system in accordance with claim 14, wherein the flow gap comprises at least one of an outlet passage or an inlet passage for conveying the fluid.

20. A masking system according to claim 17, wherein the manipulator is a program controlled robot system.

* * * * *